US005480342A

United States Patent [19]

Bannayan et al.

[11] Patent Number: 5,480,342

[45] Date of Patent: Jan. 2, 1996

[54] CENTERLESS GRINDING MACHINE CONTROL SYSTEM

[75] Inventors: John Bannayan, New York, N.Y.; Robert C. Gleason, Butler, N.J.

[73] Assignee: Glebar Company, Inc., Franklin Lakes, N.J.

[21] Appl. No.: 188,926

[22] Filed: Jan. 31, 1994

[51] Int. Cl.[6] ..... B24B 49/12

[52] U.S. Cl. ..... 451/5; 451/6; 451/11; 451/182; 451/909

[58] Field of Search ..... 451/5, 6, 8, 9, 451/10, 11, 182, 242, 245, 331, 338, 909; 72/6, 10, 12, 14, 15, 17

[56] References Cited

U.S. PATENT DOCUMENTS

| | | | |
|---|---|---|---|
| 2,394,381 | 1/1944 | Hoern | 451/909 |
| 2,402,293 | 4/1944 | Nye | 451/909 |
| 3,859,755 | 1/1975 | Schaller | 451/5 |
| 4,293,913 | 10/1981 | Nishimura et al. | 451/8 |
| 4,388,816 | 6/1983 | Ferket et al. | 72/14 |
| 4,926,603 | 5/1990 | Frost et al. | 451/5 |
| 5,177,901 | 1/1993 | Smith | 451/72 |

FOREIGN PATENT DOCUMENTS

| | | | |
|---|---|---|---|
| 0215207 | 12/1984 | Japan | 72/14 |

*Primary Examiner*—Bruce M. Kisliuk
*Assistant Examiner*—Andrew Weinberg
*Attorney, Agent, or Firm*—Fitzpatrick, Cella, Harper & Scinto

[57] ABSTRACT

A control system for controlling the position of a moveable regulating wheel in a centerless grinding machine, to provide a varying contour to the object being ground. The control system includes sensing means which measures the feed rate at which the object is being fed into the grinding machine. The rate at which the regulating wheel is moved is adjusted based on the feed rate of the object being ground, thus providing a high degree of control over the final shape of the ground object.

9 Claims, 3 Drawing Sheets

CENTERLESS GRINDING MACHINE CONTROL SYSTEM

This application is being filed with an appendix of computer program listings. A portion of the disclosure of this patent document contains material which is subject to copyright protection. The copyright owner has no objection to the facsimile reproduction by anyone of the document or the patent disclosure, as it appears in the Patent and Trademark Office files or records, but otherwise reserves all copyright rights whatsoever.

BACKGROUND OF THE INVENTION

The present invention relates to an improved apparatus and method for controlling a centerless grinding machine to more accurately control the final configuration of objects having a cylindrical cross-section. The invention is particularly useful in situations where the final configuration of the ground object is characterized by fixed lengths of varying diameters and/or tapered sections. The invention has particular application to grinding guide wires for guiding catheters during angioplastic procedures or other procedures requiring catheterization, but may be applied to any product requiring varying fixed diameters or tapers, such as golf club shafts, arrows, whip antennae and fishing rods, which may be up to ten or more feet in length.

Generally, centerless grinders are used to grind the outer surface of a rod or wire. The object of the grinding operation is to produce a wire that is round and that has a diameter and surface finish in accordance with given specifications at any given cross-section along its length.

Typically, a wire is fed into a centerless grinder at one end and guided between two grinding wheels that rotate in the same direction at different speeds, known as the work wheel and the regulating wheel. The wire rotates as a result of its contact with the regulating wheel and is ground to a specified diameter dictated by the distance between the faces of the two grinding wheels. One of the grinding wheels, typically the regulating wheel, can be moved so that the distance between the faces of the grinding wheels may be varied during the grinding process.

The wire advances through the grinding machine as a result of its contact with the grinding wheels. Specifically, one of the grinding wheels, typically the regulating wheel, rotates along an axis that is almost parallel to the axis of rotation of the wire being ground, but slightly skewed in a vertical plane, so that its contact with the wire causes the wire to move forward through the machine. The angle at which the axis is skewed is commonly referred to as the tilt angle and generally varies between one and three degrees.

A number of factors can affect the rate at which the wire moves through the grinding machine. For example, temperature, regulating wheel RPM, regulating wheel tilt angle, slippage, type of coolant used, wire diameter, wire material, wire material uniformity, and grinding wheel material may affect feed rate. Thus, the feed rate cannot accurately be controlled and often varies substantially during the grinding process.

The prior art methods of producing wire of multiple fixed diameters and tapers are deficient because they do not account for varying feed rates. For illustrative purposes it is assumed that it is desired to produce a wire as depicted in FIG. 1 having a given fixed diameter section 10 for a first unit of length 17, a tapered section 11 for a second unit of length 16, and a second fixed diameter section 12 for a third unit of length 15.

In a prior art method of grinding such a wire the work wheel is dressed, i.e., formed, so that it will produce one tapered section and one fixed diameter section on a wire in any one given pass. For example, referring to FIG. 1, it can produce fixed diameter section 10 and tapered section 11 in one pass. More particularly, the grinding face of the work wheel is configured so that as the wire moves through the space between the work wheel and the regulating wheel the gap becomes more narrow until a certain point. At that point, the face of the work wheel becomes parallel to its axis of rotation so that the size of the gap between the wheels remains the same.

In operation, the wire is fed into the machine and allowed to progress until the point of transition between the parallel and tapered sections on the work wheel matches the point along the length of the wire where the taper is to begin. The wire is then withdrawn and the regulating wheel position is adjusted to grind the second fixed diameter and tapered section of the rod. If the taper angle of the second tapered section does not match the first taper angle, an entirely new work wheel with a different dress must be used. Thus, this prior art method is cumbersome and tedious. In addition, if the operator does not stop the grinding process at precisely the correct point, which can be difficult, the length of the fixed diameter sections of the wire will not meet specifications.

In another prior art method the wire is placed on an elongated feed bed and moves longitudinally along the feed bed as it is being ground. Sensors which sense the passage of the trailing end of the wire are mounted along the feed bed so that the end of the wire passes the sensors in succession. The position of the sensors are adjustable, and the operator positions the sensors on the feed bed so that when the end of the wire passes a sensor, that event corresponds to a point in the grinding process at which a transition from a fixed diameter section to a tapered section, or vice versa, should occur. The sensors generate signals and the commencement and cessation of movement of the regulating wheel is keyed to those signals. To produce a tapered section in this prior art method, when a signal is generated by one of the sensors indicating that a taper is to begin, the regulating wheel is moved away from the work wheel at a fixed constant rate while the wire continues to be fed into the grinding machine. The rate at which the regulating wheel is moved away from the work wheel is based on an assumed constant wire feed rate. However, since the actual feed rate may vary substantially, the produced wire taper may be of irregular shape and fall outside of specified limits. This prior art method is deficient because movement of the regulating wheel is not related to the actual position of the wire or rod.

BRIEF SUMMARY OF THE INVENTION

A principal feature of the present invention is the provision of means to continuously monitor the position of a wire that is being ground in a centerless grinding machine and to control the position of the regulating wheel based on the known position of the wire. The position and feed rate of the wire is monitored and that information is then used to accurately determine when the distance between grinding wheels should be changed and the rate at which that distance should be changed. In this way precise, consistent tapers can be achieved and fixed diameter portions of the wire can be accurately produced to specified lengths.

The rod or wire that is to be ground is placed upon a feed bed and is advanced so that its leading edge enters the grinding area. At this point grinding commences and the wire begins to move through the grinding area. A plurality of sensors are mounted along the feed bed which sense the position of the wire. Signals from the sensors are processed by a central processor, which continuously calculates wire position and feed rate. The continuously updated wire position and feed rate information is used to calculate desired regulating wheel position and movement rate. Alternately, a sensor or sensors which measure feed rate directly are mounted along the feed bed and signals from such sensors are processed by the central processor to continuously calculate wire position.

The central processor also receives wire profile data through an input device from the machine operator indicating the dimensions of the wire as it is to appear after it has been ground. The operator provides the length and diameter of fixed diameter sections of the wire, and the length of the tapered sections of the wire between fixed diameter sections.

Using the position and feed rate information and the wire profile data from the operator, the central processor calculates the desired position of the regulating wheel throughout the grinding process, including the rate at which the regulating wheel must be moved to produce a given taper. The regulating wheel position calculation is constantly updated based on updated wire position and feed rate information. Thus, if a tapered section of the wire is being ground and the feed rate changes, a corresponding change is made in the rate at which the regulating wheel is being moved away or toward the work wheel.

The central processor also generates control signals which control a regulating wheel positioning mechanism, such as a stepper motor.

DESCRIPTION OF THE PREFERRED EMBODIMENTS

Figure 2:
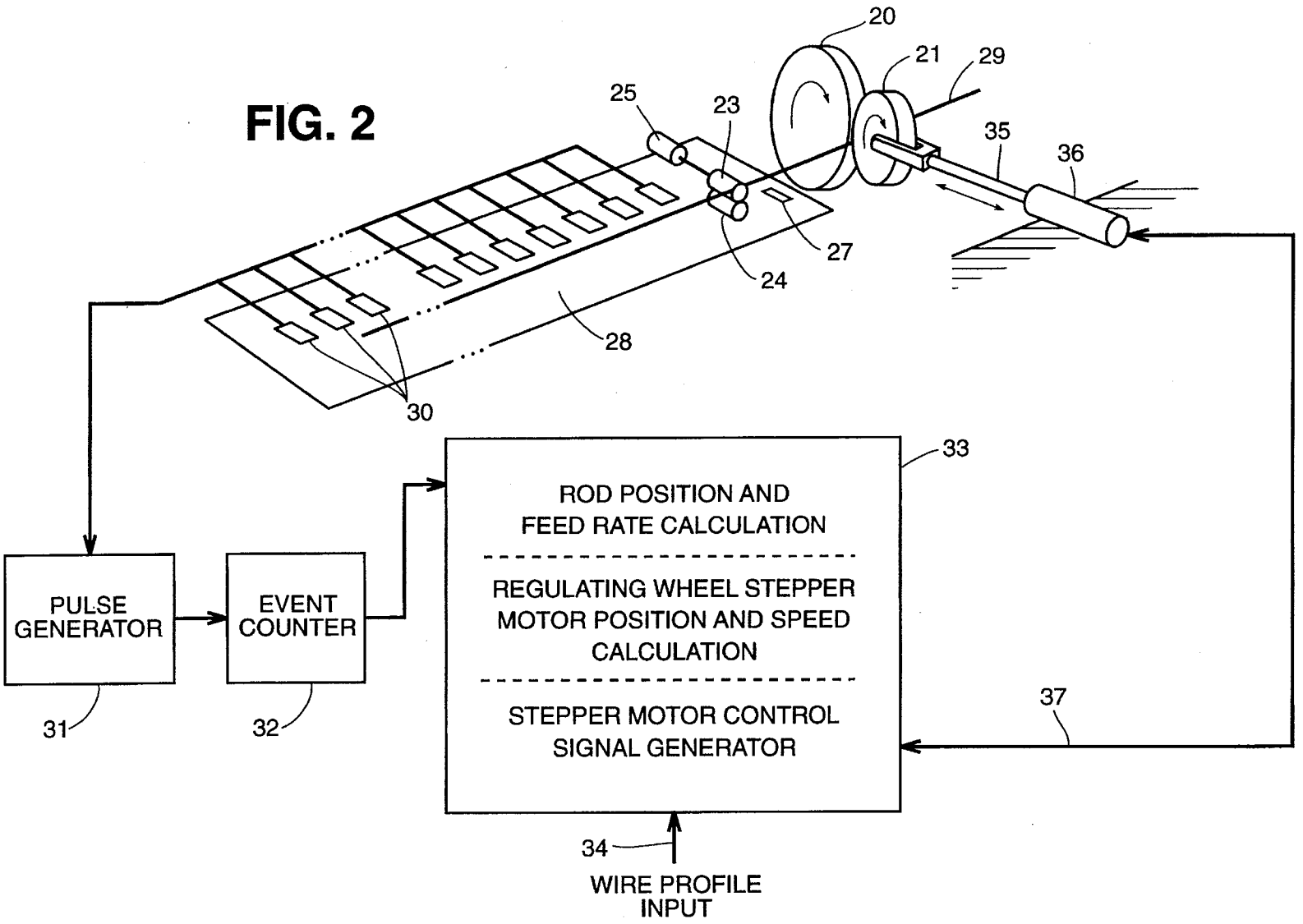
FIG. 2 is a schematic and block diagram showing details of a preferred embodiment of the invention.

FIG. 2 shows a schematic of the preferred embodiment. A rod or wire 29 that is to be ground is placed upon a feed bed 28 so that it lies between pinch rollers 23 and 24. The pinch rollers are then clamped onto the wire and it is slowly advanced via stepper motor 25 until the leading end of the wire is sensed by initiating sensor 27. The wire is then advanced a further known fixed distance so that its leading end enters the gap between work wheel 20 and regulating wheel 21.

Figure 3:
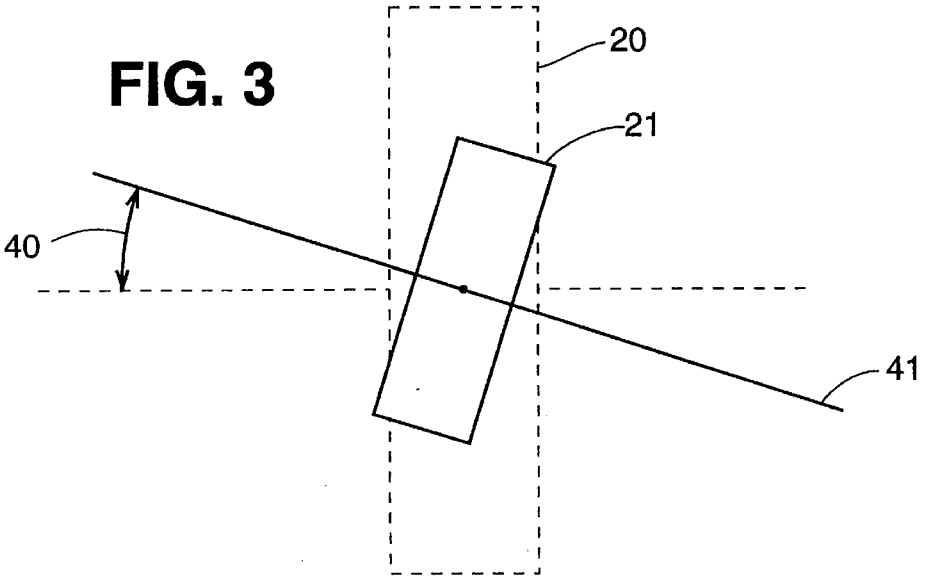
FIG. 3 is a diagram showing the orientation of the grinding wheels and the wire.

Once the wire enters the gap between the two grinding wheels, it comes into contact with them and grinding commences. The work wheel 20 and regulating wheel 21 can be composed of a variety of materials known to those skilled in the art, such as silicon carbide or aluminum oxide in vitrified form or rubber bonded. Grinding wheel material is selected in a manner known to those skilled in the art so that there is greater friction between the regulating wheel and the wire than between the work wheel and the wire, which allows the wire to be controlled by the rotation of the regulating wheel while the work wheel does all the grinding. Thus, by skewing the axis of rotation 41 of the regulating wheel in a vertical plane, as depicted in FIG. 3, the regulating wheel can be used to advance the wire through the machine.

In the preferred embodiment, work wheel 20 is approximately nine inches in diameter and spins at approximately 2500 RPM and regulating wheel 21 is approximately four inches in diameter and spins at approximately 50 RPM. The rod 29 spins as it is being ground.

Mounted along the feed bed 28 are sensors 30. In the preferred embodiment, the sensors are mounted at half-inch intervals and are photoelectric cells, such as those made by Keyence Company, which project light onto a target and sense whether light is reflected back. When the wire is present, reflected light is sensed and the sensor generates an electrical signal ("on"). After the trailing end of the wire has passed the sensor, reflected light is no longer sensed and the electrical signal is no longer generated ("off").

The sensors are connected to a pulse generator 31 which generates an electrical pulse each time a transition from "on" to "off" occurs in any of the sensors 30 on the feed bed. Thus, a pulse is generated each time the trailing end of the wire 29 passes a sensor 30 on the feed bed 28. The pulse generator 31 is known in the art and is often available from the manufacturer of the sensors being used. For example Banner Company makes pulse generators known as "one shot logic modules", which can be used with the photoelectric cells named above and used in the preferred embodiment. In addition, cells with built-in pulse generators are available on the market. For example, Banner Company manufactures a photoelectric cell with a built-in pulse generator known as "Multi-Beam®".

The pulse generator 31, or the photoelectric cells themselves if equipped with pulse generators, are connected to an event counter 32 for counting the number of pulses generated by the pulse generator 31. A register in the event counter 32 is reset to zero at the beginning of the grinding cycle after the leading end of the wire 29 has been inserted into the grinding area and is updated each time a pulse is received from the pulse generator 31. Event counters adapted for such use are available on the market. For example DGH manufactures sensor-to-computer interface modules under the D1000 series designation.

The event counter 32 is connected to a multitasking computer 33 via a standard computer interface such as an RS-232 serial interface. Any computer can be used provided it is capable of multitasking, i.e., running more than one program at a time. Many such multitasking computers are available on the market. An IWS-3025 workstation made by Nematron is used in the preferred embodiment.

The multitasking computer 33 is programmed via a feed rate calculation program to calculate the position and feed rate of the wire based on the information in the event counter. Specifically, the value in the event counter is polled continuously, that is, thousands of times a second, to see whether it has been updated. When a transition from one value to the next, for example from a "0" to a "1" or from a "1" to a "2", is noted a timer is polled to see how long it has been since the last time the event counter was updated. Since the distance between sensors is known, and the time it took the end of the wire to travel from one sensor to the next has just been measured, feed rate is easily calculated by dividing the distance travelled by the time interval. Each time the event counter 32 is updated, a new feed rate is calculated and the timer is reset to zero. Thus, in the preferred embodiment, the calculation of feed rate is updated for each half-inch of wire travel. Wire position during each half-inch interval is continuously computed based on the feed rate for the preceding half-inch interval.

The multitasking computer 33 also accepts data defining the wire profile to be achieved from the grinding process. This can be accomplished via dedicated port 34 which connects to an input device such as a keyboard or touch screen.

Figure 1:
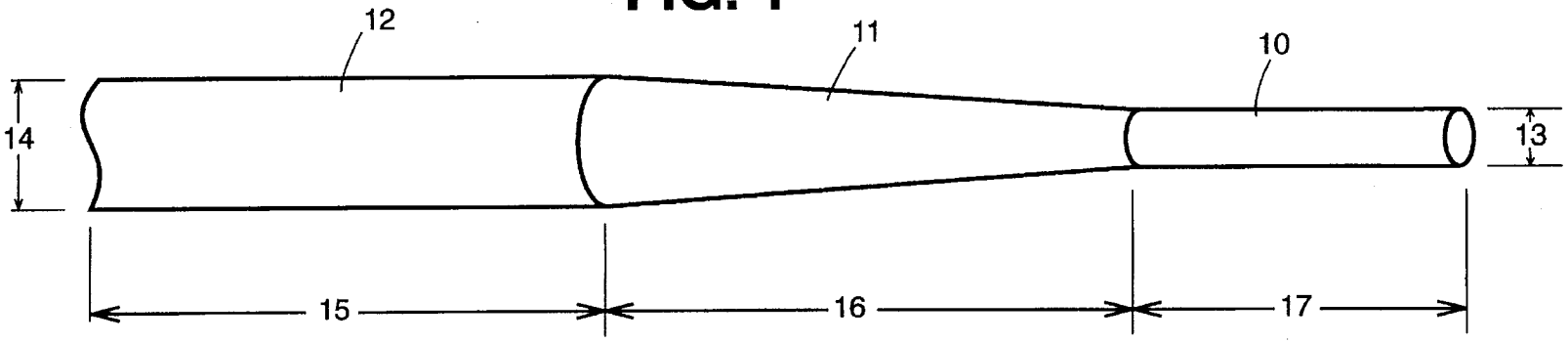
FIG. 1 depicts the profile of a wire after it has been ground by the claimed apparatus and method.

Referring to FIG. 1 there is depicted in schematic form a wire having a fixed diameter section 10, followed by a tapered section 11, followed by another fixed diameter section 12. The multitasking computer 33 accepts data from the grinding machine operator specifying the length of the fixed diameter sections, the diameter of the fixed diameter sections, and the length of tapered sections. Any number of fixed diameter sections can be specified. In addition, it may be specified that the wire increase in diameter and subsequently decrease in diameter.

The multitasking computer 33 is also programmed via a regulating wheel positioning program described below to calculate the position and rate of movement of the regulating wheel throughout the grinding process based on the input profile, the wire position and the feed rate. For example, referring to FIG. 1, the regulating wheel 21 must remain in one position while the first fixed diameter portion 10 of the rod is being ground. It must then be moved away from the work wheel 20 to produce the tapered section 11. The point in time at which the wheel begins to move and the rate at which the regulating wheel is moved away from the work wheel can be calculated by those skilled in the art based on the wire profile data and a feed rate. However, as discussed above, the feed rate is typically not constant during the grinding process, so if a constant feed rate is assumed, an improperly ground wire will result. In the present invention the feed rate calculation program is constantly polled to see whether a new feed rate has been calculated. As soon as a new feed rate is noted, the desired regulating wheel position and its desired rate of movement are redetermined.

The updated desired regulating wheel position and rate of movement are calculated based on the known positions of the wire and the regulating wheel. Thus, at any given time during the grinding of a tapered section the desired movement of the regulating wheel 21 is calculated based on the feed rate for the previous half-inch interval. When the next half-inch interval is achieved it is known precisely where on the length of the wire the grinding is taking place. If the feed rate has changed the actual position of the wire will not be precisely the same position that was assumed in calculating the regulating wheel rate of movement since the regulating wheel rate of movement was based on the previous feed rate. That discrepancy in wire position is taken into consideration in computing a new desired regulating wheel movement rate during the next half-inch interval.

To provide the adjustability of the position of the regulating wheel 21, so that the linear distance between it and the work wheel 20 is variable, the regulating wheel is slidably mounted and its position is controlled by stepper motor 36 and ball screw 35. Thus, the position of the regulating wheel 21 with respect to the work wheel 20 is a function of the angular position of the stepper motor 36 and the pitch of the ball screw 35. Likewise, its linear speed is a function of the angular speed of the stepper motor and the pitch of the ball screw. Stepper motors are readily available, such as the SXF stepper motor manufactured by Parker Compumotor which is used in the preferred embodiment, and typically come equipped with controllers that accept codes in ASCII format which dictate how the stepper motor should move. In the preferred embodiment, the stepper motor 36 is controlled by sending it codes via serial line 37 in ASCII format indicating the number of rotations, i.e., a distance code, and the speed at which the rotations should occur, i.e., a velocity code. The regulating wheel positioning program generates these commands in a manner known to those skilled in the art.

In addition to monitoring the wire position, the position of the regulating wheel stepper motor 36 is monitored as well. Stepper motors available on the market such as the one used in the preferred embodiment are equipped to transmit signals indicating the distance they have travelled. This information is transmitted to the central processor 33 via serial line 37 and is used in recalculating the desired regulating wheel position and rate of movement each time a new feed rate is generated. Thus, each time a new feed rate and wire position signal is received from the feed rate calculating means, the position of the regulating wheel stepper motor 36 is monitored to see how far the stepper motor has moved. A new taper angle is calculated based on the length remaining in the taper, which is known as a result of the rod positioning sensors, and the amount the regulating wheel must be moved to complete the taper, which is known from the stepper motor monitor. A new regulating wheel rate of movement is calculated based on the new taper angle.

In another embodiment of the invention the plurality of sensors may be replaced with a sensor which can read feed rate directly. For example Keyence Company makes a sensor which projects a laser pattern onto a moving part and computes feed rate based on a shift pattern reflected back to the sensor head. Such a sensor produces signals which vary in accordance with the feed rate. In this embodiment the pulse generator and event counter are not needed. Instead the rod position can be continuously calculated based on the continuously read feed rate. Desired regulating wheel position and movement rates are recalculated at fixed time intervals or are recalculated each time a change in feed rate is detected.

Figure 4:
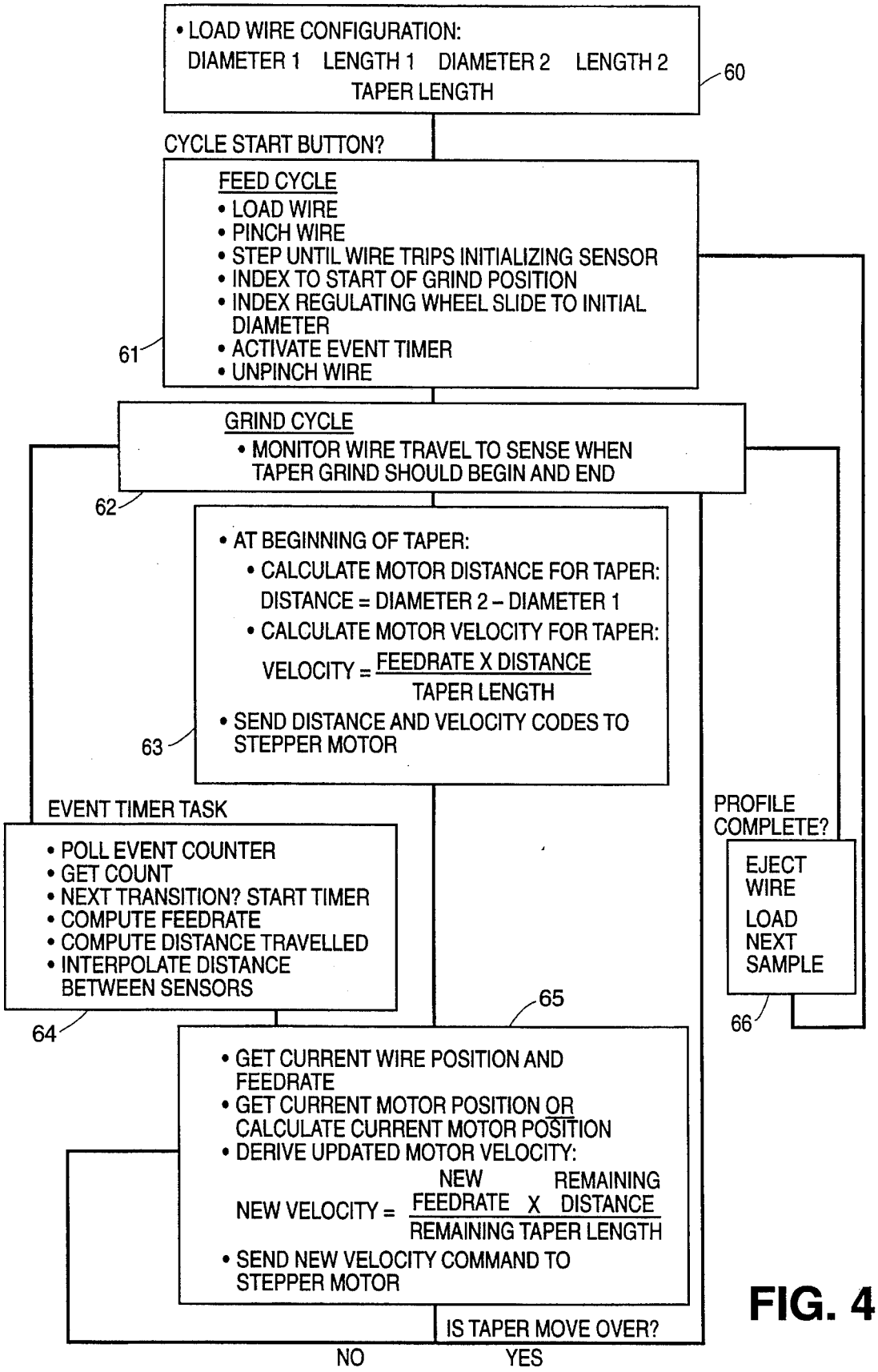
FIG. 4 is a flow chart illustrating the method of the invention.

Referring to FIGS. 3 and 4, a schematic of the method of the control system is presented. At the start of the cycle the operator provides wire profile data in step 60 indicating the lengths and diameters of fixed diameter sections and the lengths of tapered sections.

Referring to step 61 of FIG. 4, wire 29 is placed on feed bed 28 so that it is positioned between the pinch rollers 23 and 24. The pinch rollers are then clamped onto wire 29 and the wire is moved along the feed bed until its leading end reaches the initializing sensor 27. The wire is then advanced a known fixed distance to bring its leading end into the nip between the work wheel 20 and the regulating wheel 21 while the regulating wheel is moved into position to begin grinding. The event timer is then reset, the pinch rollers 23 and 24 are released and grinding commences.

As grinding takes place the position of the wire is monitored by polling the event counter, as depicted in boxes 62 and 64 of FIG. 4. As stated above, this polling occurs thousands of times per second, so it is instantly known when the trailing end of the wire has passed a sensor. Feed rate is computed as described above and set forth schematically in box 64 of FIG. 4.

After the first fixed diameter portion of the wire has been ground the grinding of a tapered section begins. To control the position of the regulating wheel 21 the stepper motor 36 must be commanded with a distance code, indicating the total distance to travel to complete the taper, and a velocity code, indicating the speed at which the wheel should be moved while travelling that distance. Referring to the first equation in box 63 of FIG. 4, the distance is derived by computing the difference between the diameter of the wire at the end of the taper and the diameter at the beginning of the taper, i.e., the difference in diameters between the fixed diameter sections. Referring to FIG. 1, the distance is Diameter 2 minus Diameter 1. Referring to the second equation in box 63 of FIG. 4, the desired stepper motor velocity is computed by multiplying the feed rate by the computed distance and then dividing by the taper length. The commands are then sent to stepper motor 36.

As discussed above, the event counter is continuously polled to monitor wire progress, and each time the trailing end of the wire passes a sensor a new feed rate is calculated. Whenever this occurs the desired stepper motor velocity is recomputed using the equation in box 65 of FIG. 4 and a new velocity command is generated. Referring to the equation in box 65 of FIG. 4 the new feedrate value is the new feedrate which has just been received. The remaining taper length is known since the wire position is known. The remaining distance is derived by computing the difference between the desired diameter of the wire at the end of the tapered section and the then current wire diameter. The current wire diameter can be derived two ways. One way to derive it is by multiplying the velocity of the regulating wheel over the last half-inch interval by the time elapsed since the feed rate was last updated. Another way to derive it is by directly monitoring the position of the stepper motor via serial line 37. As discussed, stepper motors are available that provide information on their current position. Once the new distance is computed, velocity is computed by multiplying the remaining distance by the new feed rate and then dividing by the remaining taper length. Referring to box 65 of FIG. 4, a velocity command is recomputed each time a new feed rate is computed, and the stepper motor 36 is commanded accordingly, until grinding of the tapered section is completed.

Once the taper has been completed, the method progresses from step 65 back to step 62 of FIG. 4. If the entire wire has been ground the wire is removed from the machine in step 66 of FIG. 4 by pulling the wire back out of the machine via pinch rollers 23 and 24 and stepper motor 25. A new feed cycle, step 61, can then begin. If instead more grinding must take place the program progresses beginning with step 62 to continue grinding.

The above described method is applicable to wires of many different desired configurations. For example, wires that begin with tapered sections, and wires that have consecutive tapered sections but with different taper angles, can also be produced.

The programming of a system as described above will be apparent to all those skilled in the art. To provide further guidance, a copy of the source code used by the inventors in programming their system has been annexed as Appendix A. This code is provided for exemplary purposes only, and in no way is intended to limit the scope of this invention.

APPENDIX A

```
20 STRING FS$(20),P$(30),X$(20),Y$(20),Z$(20),ECHO$(40),ENTRY$(7)
30 DIM D(10),T(10),C(10)
40 PITCH=.5' SENSOR DETECTION PITCH
50 COLUMN=80  ROW=10
60 TASK 1,JOG1
70 TASK 2,JOG2
80 TASK 3,JOG3
90 TASK 4,RESETMOTOR
100 TASK 5,DISPLAYPOS
110 TASK 6,MOVER
120 TASK 7,COUNTER
130 TASK 8,INTER'IN BETWEEN SENSOR DISTANCE
140 CLS : CLEARBUFFER 0
150 IPRINT (10,15) ,"MOTOR STATUS" : PRINT
160 PRINT #1 "K 1RSE "
170 LINEINPUT #1 Z$,20,10 : IF LEN(Z$)=0 THEN PRINT DFILE("MOTORERROR")
180 PRINT Z$:' Z$=INKEY#1   IF Z$<>CHR(62) THEN 170
190 PRINT #1 "MR15 1TF20 1FSB0 SLD3 1ER400 AD300 1FOL100 MN LD3 FSI0 A5 V5 "
200 PRINT #1 "1O0110 ON 1SSI1 2SSI1 1OFF 2V1 1"CHR(34)"> "
210 Z$=INKEY#1 : IF Z$<>">" THEN 210
220 Z$=INKEY#1 : IF Z$<>">" THEN 220
230 INVALID=1
240 READFILE "DTOT",1,DTOT,FIRSTDIA,INDIST,RETIN
250 FOR I=1 TO DTOT
260  READFILE "N",I,D(I),C(I),T(I)
270 NEXT I
280 FOR I=1 TO 7000 : NEXT I
290 PRINT #1 "1ON 1ON 1"CHR(34)"> "
300 Z$=INKEY#1 : IF Z$<>">" THEN 300
310 Z$=INKEY#1 : IF Z$<>">" THEN 310
320 SDIAMETER=FIRSTDIA/254000
330 GOSUB HOMER
340 PRINT #1 "1PZ 1FSB1 1PZ 1FSB0 1PZ "'MAKE SURE BOTH COUNTERS READ 0 AT HOME
350 'TOP
360 '------------- MAIN -----------------
370 MAIN:
380 CLS
390 CONT=0
400 PRINT DFILE("WMAIN")
410 IF INVALID=1 THEN PRINT DFILE("FLASHER")
420 A$=INKEY
430 IF A$="" THEN 420
440 IF A$="A" THEN IF INVALID=0 THEN WIRERUN
450 IF A$="B" THEN JOG
460 IF A$="C" THEN GOSUB SETUP
470 GOTO 380
480 '------------ WIRERUN -------------
490 WIRERUN: OKTOGO=1 : CLS : VEL=.00178 : VELUP=.00178
500 PRINT #1 "K 1OXX10 1"CHR(34)"& "
510 Z$=INKEY#1 : IF Z$<>"&" THEN 510
520 Z$=INKEY#1 : IF Z$<>"&" THEN 520
530 IF INVALID=1 THEN GOTO MAIN
540 GOSUB CLEARVARS
550 PRINT DFILE("WIRERUN") : PRINT DFILE("CONTOFFW")
560 IF CONT=0 THEN PRINT DFILE("CONTOFFW")
570 IF CONT=1 THEN PRINT DFILE("CONTONW")
580 B$=INKEY
590 IF B$="E" THEN DISMISS 6 : DISMISS 7 : GOSUB CLEARVARS : GOSUB RESET
600 IF B$="F" THEN DISMISS 6 : DISMISS 7 : GOSUB CLEARVARS : GOTO CLEAN
```

```
610 IF B$="K" THEN IF OKTOGO=1 THEN CLEARBUFFER 0  GOSUB SINGLE
620 IF B$="L" THEN IF OKTOGO=1 THEN CLEARBUFFER 0  GOSUB CONTON
630 GOTO 580
640 '----------SINGLE ----------
650 SINGLE: CLEARBUFFER 0
660 PRINT #1 "K 1OXXX1 T.5 1OXXX0 1"CHR(34)"@ "
670 Z$=INKEY#1   IF Z$<>"@" THEN 670
680 Z$=INKEY#1   IF Z$<>"@" THEN 680
690 SINGLE=1
700 PRINT DFILE("SINGLEW")
710 FOR I=1 TO 1000 : NEXT I
720 PRINT DFILE("SINGLEOW")
730 ACTIVATE 6
740 RETURN
750 '----------CONT ON ----------
760 CONTON: CLEARBUFFER 0
770 IF CONT=0 THEN CNT=1
780 IF CONT=1 THEN CNT=0
790 IF CNT=1 THEN PRINT DFILE("CONTONW")
800 IF CNT=1 THEN ACTIVATE 6
810 SINGLE=0
820 'F CNT=0 THEN DISMISS 6
830 IF CNT=1 THEN CONT=1
840 IF CNT=0 THEN CONT=0
850 RETURN
860 '-------- CLEANUP RETRACT ALL AND GOTO MAIN
870 CLEAN: DISMISS 6
880 PRINT #1 "Y NG K K 1OXX11 1FSB0 1FSC0 1MN 1MPA 1V1 1D0 1G 1"CHR(34)"> "
890 Z$=INKEY#1  : IF Z$<>">" THEN 890
900 Z$=INKEY#1  : IF Z$<>">" THEN 900
910 GOTO MAIN
920 '==========MOVE MOTOR ==========
930 ' VAR1 = VELOCITY, VAR2 = DISTANCE TRAVELED
940 MOVER: 'YO TASK 6
950 '------FEED SEQUENCE ----------
955 ACTIVATE 8' LOOK FOR LEADING EDGE ON SENSOR RETURN T1
960 IN$=STR(INT((INDIST*50000)/1.57))
970 PRINT #1 "K K T.5 1OXX00 "
980 PRINT #1 "2MPI 2D500 2V5 WHILE(INXXXX0) 2G NWHILE 1";CHR(34);"2S "
990 PRINT #1 "1"CHR(34)"% "
1000 Z$=INKEY#1  : IF Z$<>"%" THEN 1000
1010 Z$=INKEY#1  : IF Z$<>"%" THEN 1010
1020 PRINT #1 "K K 2MN 2MPI 2A15 2AD15 2V1 2D+";IN$;" 2G 2";CHR(34);"& "
1030 Z$=INKEY#1  : IF Z$<>"&" THEN 1030
1040 Z$=INKEY#1  : IF Z$<>"&" THEN 1040
1045 DISMISS 8 : GTM T2 : INBET=T2-T1 : INBET=.5-(INBET*1.57)
1046 PRINT USING "##.#####" ;INBET
1050 '-------- GO TO FIRST, SMALLEST DIAMETER
1060 PRINT #1 "1SLD2 1O101X 1NG 1O101X 1FSB0 1MN 1MPA 1V1 1O "
1070 Z$=INKEY#1  : IF Z$<>"*" THEN 1070
1080 Z$=INKEY#1  : IF Z$<>"1" THEN PRINT "A B O R T  C Y C L E" : END
1090 PRINT #1 "1O101X 1NG 1FSB0 1MN 1MPA 1V1 1D";FIRSTDIA;" 1G 1"CHR(34)"> "
1100 Z$=INKEY#1  : IF Z$<>">" THEN 1100
1110 Z$=INKEY#1  : IF Z$<>">" THEN 1110
1120 DV1=D(1) : DV2=D(2) : TRANS=T(1) : LEN1=C(1)
1130 GOSUB PR
1140 '-----TRANSITION LOOP -
1150 CLEARBUFFER 2 : GOSUB CLEARCOUNTER
1160 ACTIVATE 7
1170 N=1 : ELTRAVEL=C(N)' DEFINE FIRST TRANSITION
```

```
1180 TLOOP: IF TRAVEL>=ELTRAVEL THEN GOSUB PASSVARS : GOSUB GRIND
1190 IF N<>DTOT THEN GOTO TLOOP
1200 '----------EJECTOR, LOAD SEQUENCE
1210 EJECTOR:
1220 RETRCT$=STR(INT((RETIN*50000)/1.57))
1230 PRINT #1 "1NG 1NG 1T1 1MN 1MPI 1V1 1D-2286 1G 1",CHR(34);"$ "
1240 Z$=INKEY#1 : IF Z$<>"$" THEN 1240
1250 Z$=INKEY#1 : IPRINT (1,80) Z$ : IF Z$<>"$" THEN 1250
1260 'ISMISS 7' TURN COUNTER OFF
1270 'OSUB CLEARCOUNTER
1280 PRINT #1 USING "######" ;"1FSB0 1FSC0 1V.1 2MPI 2D-",RETRCT$;" "
1290 PRINT #1 "2V23 2A100 2AD100 1OXX01 T.5 2G 2";CHR(34);"! "
1300 Z$=INKEY#1 : IF Z$<>"!" THEN 1300
1310 Z$=INKEY#1 : IPRINT (1,80) Z$ : IF Z$<>"!" THEN 1310
1320 PRINT #1 "K 1OXX10 1";CHR(34);"# "
1330 Z$=INKEY#1 : IF Z$<>"#" THEN 1330
1340 Z$=INKEY#1 : IPRINT (1,80) Z$ : IF Z$<>"#" THEN 1340
1350 IF SINGLE=1 THEN DISMISS 6 : SINGLE=0
1355 DISMISS 7' TURN COUNTER OFF
1356 GOSUB CLEARCOUNTER
1360 END
1370 '---PASS VARIABLES ----
1380 PASSVARS: DV1=D(N) : DV2=D(N+1) : TRANS=T(N) : LEN1=C(N) : LEN2=C(N+1)
1390 ELTRAVEL=ELTRAVEL+TRANS+C(N+1) : N=N+1 : RETURN
1400 '---CLEAR COUNTER VARIABLES----
1410 CLEARVARS:
1420 DISMISS 7 : DISMISS 8' TURN COUNTER OFF
1430 TRAVEL=0 : ELAPSED=0 : ELTRAVEL=0 : COUNT1=0 : COUNT2=0
1440 GOSUB CLEARCOUNTER
1450 RETURN
1460 '----------TRANSITION GRINDING SUBROUTINE
1470 GRIND: EL=(ABS(DV2-DV1))
1480 OFSET=POSITION
1490 DIST=INT(ABS((DV2-DV1))*25400) : VEL=((FEEDRATE*DIST*5.08)/(TRANS*25400))
1500 PRINT #1 USING "#.####" ;"1O10XX 1NG 1FSB1 1FSC1 1MN 1MPI 1V";VEL;" "
1510 PRINT #1 "1"CHR(34)"@ "
1520 Z$=INKEY#1 : IF Z$<>"@" THEN 1520
1530 Z$=INKEY#1 : IPRINT (1,80) Z$ : IF Z$<>"@" THEN 1530
1540 PRINT #1 USING "###" ;"1MPP 1D-";DIST;" 1G 1"CHR(34)"> "
1550 Z$=INKEY#1 : IF Z$<>">" THEN 1550
1560 Z$=INKEY#1 : IPRINT (1,80) Z$ : IF Z$<>">" THEN 1560
1570 'LEARBUFFER 1 : CLEARBUFFER 4
1580 ALPHA=ATN(EL/TRANS)'TRANSITIONAL ANGLE
1590 P2=POSITION : GOSUB PR : GOSUB VELUPR
1600 EL=ABS(POSITION-OFSET+(DV2-DV1)) : IF POSITION<>P2 THEN GOTO 1590
1610 PRINT #1 "1NG 1NG 1"CHR(34)"% "
1620 Z$=INKEY#1 : IF Z$<>"%" THEN 1620
1630 Z$=INKEY#1 : IPRINT (1,80) Z$ : IF Z$<>"%" THEN 1630
1640 EL=0 : VEL=0 : VELUP=0 : ALPHA=0 : RETURN
1650 '--- UPDATE VELOCITY BASED ON FEEDRATE DURING TRANSITION
1660 VELUPR:
1670 IF (EL/TAN(ALPHA))<>0 THEN VELUP=((FEEDRATE*EL*5.08)/((EL/TAN(ALPHA))))
1680 IF VELUP<.0001 THEN VELUP=.0001
1690 PRINT #1 USING "#.####" ;"1IV";VELUP;" 1"CHR(34)"+ "
1700 Z$=INKEY#1 : IF Z$<>"+" THEN 1700
1710 Z$=INKEY#1 : IPRINT (1,80) Z$ : IF Z$<>"+" THEN 1710
1720 VEL=VELUP
1730 RETURN
1740 '----------RESET SEQUENCE TAKES EVERYONE HOME
1750 RESET: DISMISS 6 : DISMISS 8 : PRINT DFILE("CONTOFFW")
```

```
1760 PRINT #1 "Y NG K K 1FSB0 1FSC0 1MN 1MPA 1V1 1D0 1G 1OXXX1 T.5 "
1770 PRINT #1 "1OXX10 T.5 1"CHR(34)"$ "
1780 Z$=INKEY#1  : IF Z$<>"$" THEN 1780
1790 Z$=INKEY#1  : IF Z$<>"$" THEN 1790
1800 EL=0 : OFSET=0
1810 RETURN
1820 '---------- JOG ------------------
1830 JOG: CLEARBUFFER 0 : DISMISS 5
1840 PRINT #1 "K K K 1FSB0 1FSC0 1O01XX 1"CHR(34)"> "TURN ON MANUAL ENCODER
1850 Z$=INKEY#1  : IF Z$<>CHR(62) THEN 1850
1860 Z$=INKEY#1  : IF Z$<>CHR(62) THEN 1860
1870 ACTIVATE 5 : ACTIVATE 2 : CLEARBUFFER 0
1880 PRINT DFILE("WJOG")
1890 C$=INKEY
1900 IF C$="" THEN 1890
1910 IF C$="G" THEN ACTIVATE 1 : DISMISS 2 : DISMISS 3 : GOTO 1890
1920 IF C$="H" THEN ACTIVATE 3 : DISMISS 1 : DISMISS 2 : GOTO 1890
1930 IF C$="I" THEN ACTIVATE 2 : DISMISS 1 : DISMISS 3 : GOTO 1890
1940 IF C$="J" THEN ACTIVATE 4 : DISMISS 1 : DISMISS 2 : DISMISS 3 : GOTO MAIN
1950 IF C$="K" THEN DISMISS 5 : DISMISS 1 : DISMISS 2
1960 IF C$="K" THEN DISMISS 3 : GOSUB SDIA : ACTIVATE 4 : GOTO MAIN
1970 IF C$="L" THEN DISMISS 5 : DISMISS 1 : DISMISS 2
1980 IF C$="L" THEN DISMISS 3 : GOSUB SLD : ACTIVATE 4 : GOTO MAIN
1990 GOTO 1890
2000 '---------- SET START DIAMETER
2010 SDIA: 'RECONFIGURE FIRST DIAMETER DISTANCE FROM HOME POSIION
2020 FIRSTDIA=(POSITION*254000)
2030 WRITEFILE "DTOT",1,DTOT,FIRSTDIA
2040 SDIAMETER=FIRSTDIA/254000 : RETURN
2050 '---------- SET CLOCKWISE LIMIT
2060 SLD: 'SET CLOCKWISE LIMIT
2070 IF INVALID=0 THEN RETURN
2080 CLIMIT=POSITION*254000
2090 PRINT #1 "Y Y K K 1SLD3 1SL-15000,";CLIMIT;" 1SLD2 1"CHR(34)"> "
2100 G$=INKEY#1  : IF G$<>CHR(62) THEN 2100
2110 MAXTRAVEL=CLIMIT/254000
2120 INVALID=0 : RETURN
2130 '--------JOG 0.00001 ------
2140 JOG1: ' TASK 1
2150 PRINT DFILE("JOG1")
2160 CLEARBUFFER 0
2170 PRINT #1 "Y K H- A50 V10 FSI1 FSP1 FOL100 FOR0.635 MPP MC 1G L 1PR T.5 N "
2180 DISMISS 1 : END
2190 '------- RESET CONTROL ---
2200 RESETMOTOR: TASK 4
2210 CLEARBUFFER 0
2220 DISMISS 5
2230 PRINT #1 "E E E Y Y K K NG 1FSI0 1OX1X0 1FSB0 1FSC0 1MN 1MPA 1D0 1V1 1G "
2240 PRINT #1 "1"CHR(34)"> "
2250 G$=INKEY#1  : IF G$<>CHR(62) THEN 2250
2260 '$=INKEY#1  : IF G$<>CHR(62) THEN 1335
2270 CLEARBUFFER 0 : CLEARBUFFER 1
2280 DISMISS 1
2290 DISMISS 2
2300 DISMISS 3
2310 DISMISS 4
2320 DISMISS 5
2330 END
2340 '---------JOG 0.001 ------
2350 JOG2: '0.001
```

```
2360 PRINT DFILE("JOG3")
2370 CLEARBUFFER 0
2380 PRINT #1 "Y K H- A100 V10 FSI1 FSP1 FOL100 FOR63.5 MPP 1MC 1G L 1PR T.5 N"
2390 DISMISS 2  END
2400 '--------- DISPLAY PR -----
2410 DISPLAYPOS.
2420 LINEINPUT #1 P$ : IF LEN(P$)>2 THEN POSITION=(VAL(MID(2,18,P$))/254000)
2430 GOTO 2420
2440 'P2=POSITION : GOSUB PR . IF POSITION<>P2 THEN GOTO 1395
2450 END
2460 '---------- JOG 0.0001 ----
2470 JOG3: '0.0001
2480 PRINT DFILE("JOG2")
2490 CLEARBUFFER 0
2500 PRINT #1 "Y K H- A50 V10 FSI1 FSP1 FOL110 FOR6.35 MPP MC 1G L 1PR T.5 N "
2510 DISMISS 3 : END
2520 '---------- SETUP ------------
2530 SETUP: CLEARBUFFER 0 : CLS
2540 PRINT DFILE("SETUPW")
2550 PRINT MODE(1,5)
2560 IPRINT (3,5) "RETRACTING DIST   ";USING "### #" ;RETIN
2570 IPRINT (4,5) "INDEX DISTANCE    ";USING "##.#" ;INDIST
2580 IPRINT (5,5) "NUMBER OF DIAMETERS TO GRIND   ";USING "##" ;DTOT
2590 IPRINT (6,5) "EDIT SEGMENT #  ";USING "##" ;N
2600 IPRINT (8,5) "DIAMETER   ";USING "##.#####" ;D(N)
2610 IPRINT (9,5) "STRAIGHT SEGMENT LENGTH   ";USING "##.#####" ;C(N)
2620 IPRINT (10,5) "TAPER LENGTH   ";USING " ##.#####" ;T(N)
2630 KEYINDATA:
2640 IPRINT (3,22) %7">";%0
2650 ENTRY=RETIN : GOSUB DATAENTRY : IF SW=1 THEN GOTO SHOWWIRE
2660 RETIN=ENTRY : IF RETIN>200 THEN RETIN=200
2670 IPRINT (3,23) USING "###.#" ;RETIN : IPRINT (4,22) %7">";%0
2680 IPRINT (3,22) " "
2690 ENTRY=INDIST : GOSUB DATAENTRY : IF SW=1 THEN GOTO SHOWWIRE
2700 INDIST=ENTRY : IF INDIST>20 THEN INDIST=20
2710 IPRINT (4,23) USING "##.#" ;INDIST : IPRINT (5,35) %7">";%0
2720 IPRINT (4,22) " "
2730 ENTRY=DTOT : GOSUB DATAENTRY : IF SW=1 THEN GOTO SHOWWIRE
2740 DTOT=ENTRY : IF DTOT>7 THEN DTOT=7
2750 IPRINT (5,36) USING "##" ;DTOT : IPRINT (6,20) %7">";%0
2760 IPRINT (5,35) " "
2770 ENTRY=N : GOSUB DATAENTRY : IF SW=1 THEN GOTO SHOWWIRE
2780 N=ENTRY : IF N>DTOT THEN N=DTOT
2790 IPRINT (6,21) USING "##" ;N
2800 IPRINT (8,15) %7">";%0 : IPRINT (6,20) " "
2810 IPRINT (8,16) USING "##.####" ;D(N)
2820 IPRINT (9,31) USING " ##.####" ;C(N)
2830 IPRINT (10,20) USING " ##.####" ;T(N)
2840 ENTRY=D(N) : GOSUB DATAENTRY : IF SW=1 THEN GOTO SHOWWIRE
2850 D(N)=ENTRY
2860 IPRINT (8,16) USING "##.####" ;D(N)
2870 IPRINT (9,30) %7">";%0 : IPRINT (8,15) " "
2880 ENTRY=C(N) : GOSUB DATAENTRY : IF SW=1 THEN GOTO SHOWWIRE
2890 C(N)=ENTRY
2900 IPRINT (9,31) USING "##.####" ;C(N)
2910 IPRINT (10,19) %7">";%0 : IPRINT (9,30) " "
2920 ENTRY=T(N) : GOSUB DATAENTRY : IF SW=1 THEN GOTO SHOWWIRE
2930 T(N)=ENTRY
2940 IPRINT (10,20) USING "## ####" ;T(N)
2950 IPRINT (3,22) %7">";%0 : IPRINT (10,19) " "
```

```
2960 GOTO KEYINDATA
2970 '----------
2980 DATAENTRY
2990 X$=INKEY  IF X$="C" THEN DATAENTRY
3000 IPRINT (2,45) ,%1,ENTRY$,%0 : ENTRY$=ENTRY$+X$
3010 IF X$="X" THEN ENTRY$="" : GOTO SAVECHANGES
3020 IF X$="Y" THEN ENTRY$="" : SW=1  RETURN
3030 IF X$="*" THEN ENTRY$="" : IPRINT (2,45) "      "  GOTO 2990
3040 IF X$<>CHR(13) THEN 2990
3050 IF ENTRY$=CHR(13) THEN ENTRY$="" : IPRINT (2,45) "      "  RETURN
3060 ENTRY=VAL(ENTRY$) : ENTRY$=""
3070 IPRINT (2,45) "      " : RETURN
3080 '---SAVE CHANGES AND EXIT
3090 SAVECHANGES:
3100 'DS
3110 WRITEFILE "DTOT",1,DTOT,FIRSTDIA,INDIST,RETIN
3120 FOR I=1 TO DTOT
3130  WRITEFILE "N",I,D(I),C(I),T(I)
3140 NEXT I
3150 IPRINT (2,45) "Saving..."
3160 GOTO MAIN
3170 '-----------------------------------
3180 PR: X$=""
3190 PRINT #1 "1"CHR(34)"&"
3200 U$=INKEY#1  : IF U$<>"&" THEN 3200
3210 U$=INKEY#1  : IF U$<>"&" THEN 3210
3220 PRINT #1 "1PX "
3230 U$=INKEY#1  : X$=X$+U$
3240 IF U$<>CHR(13) THEN 3230
3250 'F LEN(X$)>5 THEN PRINT "LEN"LEN(X$),X$,MID(7,11,X$)
3260 IF LEN(X$)>5 THEN POSITION=VAL(MID(7,11,X$))/25400
3270 'X$="" : CLEARBUFFER 1 : CLEARBUFFER 4
3280 RETURN
3290 '-------- PZ ------------
3300 PZ:
3310 PRINT #1 "K PZ 1"CHR(34)"> "
3320 X$=INKEY#1  : IF X$<>CHR(62) THEN 3320
3330 POSITION=0
3340 RETURN
3350 '---- HOMER -------------
3360 HOMER: CLS  : IPRINT (5,3) ,%15;" S E E K I N G  H O M E";%0
3370 PRINT #1 " K K 1FSB0 1O10XX 1GHA.5 1GHAD.5 1GH-.04 1PZ 1";CHR(34);"! "
3380 X$=INKEY#1  : IF X$<>"!" THEN 3380
3390 X$=INKEY#1  : IF X$<>"!" THEN 3390
3400 'TOP ' #1 "1PZ 1PZ 1PZ "
3410 RETURN
3420 '-------- INTER SENSOR DIST------
3430 INTER: 'TASK 8
3431 COUNT2=COUNT1
3440 PRINT #2 "$1RE "
3450 LINEINPUT #2 COUNT$
3460 IF LEN(COUNT$)>2 THEN COUNT1=VAL(MID(2,7,COUNT$))
3465 IF COUNT1<>COUNT2 THEN GTM T1
3466 GOTO INTER
3467 END
3470 '---------COUNTER -----------
3480 COUNTER: 'TASK 7
3490 COUNT2=COUNT1
3500 PRINT #2 "$1RE "
3510 LINEINPUT #2 COUNT$
```

```
3520 IF LEN(COUNT$)>2 THEN COUNT1=VAL(MID(2,7,COUNT$))
3530 IF COUNT1=COUNT2 THEN GTM T1
3540 IF COUNT1<>COUNT2 THEN GTM T2
3550 ELAPSED=T1-T2
3560 IF COUNT1<>COUNT2 THEN FEEDRATE=F
3570 IF ELAPSED>0 THEN F=PITCH/ELAPSED
3580 FE=(FEEDRATE*ELAPSED) : TP=PITCH
3590 IF FE<=PITCH THEN TRAVEL=INBET+(PITCH*COUNT1)+(FEEDRATE*ELAPSED)-PITCH
3600 GOTO COUNTER
3610 END
3620 '----------CLEARCOUNTER-------
3630 CLEARCOUNTER: CLEARBUFFER 2 : CLEARBUFFER 5
3640 DISMISS 7 : CLEARBUFFER 2 : CLEARBUFFER 5
3650 PRINT #2 "$1WE "
3660 LINEINPUT #2 X$,5,5 : CLEARBUFFER 2 : CLEARBUFFER 5
3670 PRINT #2 "$1EC "
3680 LINEINPUT #2 X$,5,5
3690 TRAVEL=0 : ELAPSED=0 : ELTRAVEL=0 : COUNT1=0 : COUNT2=0
3700 RETURN
3710 '------- SHOW WIRE ------
3720 SHOWWIRE:
3730 CLS
3740 IF (D(DTOT)-D(1))>0 THEN XSCALE=(ROW/2)/(D(DTOT)-D(1))
3750 PRINT DFILE("ZONES")
3760 COL=COLUMN : RW=ROW
3770 FOR N=1 TO DTOT
3780   FOR I=COL TO COL-7 STEP -1
3790     RW=ROW-INT(XSCALE*D(N))
3800     IF RW>0 THEN IPRINT (RW,I) ;%12;"r";%13
3810   NEXT I
3820   IF RW>0 THEN IPRINT (RW+1,I+2) USING "#.####" ;D(N)
3830   COL=COL-8
3840   IF N<DTOT THEN IPRINT (14,COL+2) "LENGTH"
3850   IF N<DTOT THEN IPRINT (15,COL+2) USING "##.###" ;C(N)
3860   COL=COL-8
3870   IF N<DTOT THEN IPRINT (14,COL+2) "TAPER";N
3880   IF N<DTOT THEN IPRINT (15,COL+2) USING "##.###" ;T(N)
3890 NEXT N
3900 ZLOOP: Z$=INKEY : IF Z$="" THEN ZLOOP
3910 IF Z$="Y" THEN N=1
3920 IF Z$="X" THEN N=1
3930 IF Z$="W" THEN N=2
3940 IF Z$="V" THEN N=2
3950 IF Z$="U" THEN N=3
3960 IF Z$="T" THEN N=3
3970 IF Z$="S" THEN N=4
3980 IF Z$="R" THEN N=4
3990 IF Z$="Q" THEN N=5
4000 IF Z$="P" THEN N=5
4010 SW=0 : GOTO SETUP
4020 END
```

What is claimed is:

1. In a centerless grinding machine for grinding an object at the nip between a grinding wheel and a regulating wheel, wherein one of the wheels is moveable for being adjustably positioned with respect to the other wheel to vary the amount of grinding to which the object is subjected, a control system for providing output control signals for use in adjusting the position of the moveable wheel, comprising:

sensor means for sensing, throughout a grinding process, the longitudinal position of an elongated object that is being fed into the grinding machine, and for producing signals indicating the position of said object;

calculating means coupled to said sensor means for receiving said signals and for calculating a feed rate signal indicating the feed rate of said object throughout the grinding process;

processing means coupled to said calculating means for receiving and storing data which defines the desired shape of the object as it is to appear after grinding has been completed and for calculating the desired position and rate of movement that the moveable wheel should assume throughout the grinding process to produce an object in accordance with said stored data, wherein said processing means continuously recalculates said desired regulating wheel position and rate of movement based on updated feed rate signals from said calculating means and generates control signals to control the position of said moveable wheel.

2. The device of claim 1 wherein said sensor means comprises a plurality of sensors arranged at known intervals along the path followed by said object as it is being fed into said grinding machine.

3. The device of claim 2 wherein said sensors sense the presence or absence of an object and generate a signal pulse when a transition from sensing the presence of an object to sensing the absence of an object occurs.

4. The device of claim 3 wherein said sensors are photoelectric cells.

5. The device of claim 1 wherein said sensor means consists of a plurality of sensors arranged at known intervals along the path followed by said object as it is being fed into said grinding machine and a pulse generator operatively connected to each sensor.

6. The device of claim 5 wherein said plurality of sensors generate two signals, one of which indicates that the sensor senses the presence of the object being fed into the grinding machine and another signal which indicates that the sensor senses the absence of the object being fed into the grinding machine, and wherein said pulse generator generates an output signal each time one of said sensors changes its output signal from the signal indicating the presence of said object to the signal indicating the absence of said object.

7. The device of claim 6 wherein said sensors are photoelectric cells.

8. The device of claim 1 wherein said processing means monitors the actual position of said moveable wheel and utilizes such information each time said desired moveable wheel position and rate of movement are recalculated.

9. In a centerless grinding machine for grinding an object at the nip between a grinding wheel and a regulating wheel, wherein one of the wheels is moveable via positioning means for being adjustably positioned with respect to the other wheel to vary the amount of grinding to which the object is subjected to produce a ground object with a configuration in accordance with specified profile data, a method of controlling the position and rate of movement of said moveable wheel comprising:

monitoring the rate at which said object is fed into said grinding machine and generating signals indicating said rate;

calculating the desired position and rate of movement that said moveable wheel should assume throughout the grinding process to produce a profile on said object in accordance with said profile data, wherein said calculation is based on said profile data and said signal indicating feed rate;

recomputing said moveable wheel desired position and rate of movement each time said signal indicating feed rate changes; and generating control signals to control said moveable wheel positioning means based on said moveable wheel desired position and rate of movement calculations.

* * * * *